US006530347B2

(12) United States Patent
Takahashi et al.

(10) Patent No.: US 6,530,347 B2
(45) Date of Patent: Mar. 11, 2003

(54) COOLING APPARATUS FOR LIQUID-COOLED INTERNAL COMBUSTION ENGINE

(75) Inventors: Eizo Takahashi, Chiryu (JP); Masataka Ota, Anjo (JP); Kazutaka Suzuki, Kariya (JP); Yoshikazu Shinpo, Nisshin (JP)

(73) Assignees: Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/955,243

(22) Filed: Sep. 17, 2001

(65) Prior Publication Data

US 2002/0050251 A1 May 2, 2002

(30) Foreign Application Priority Data

Sep. 18, 2000 (JP) ..... 2000-282257

(51) Int. Cl.[7] ..... F01P 7/16
(52) U.S. Cl. ..... 123/41.1; 123/41.31
(58) Field of Search ..... 123/41.1, 41.31, 123/41.33

(56) References Cited

U.S. PATENT DOCUMENTS 4,535,729 A * 8/1985 Faylor ..... 123/41.1
5,390,632 A 2/1995 Ikebe et al. ..... 123/41.02
6,325,026 B1 * 12/2001 Suzuki ..... 123/41.1

FOREIGN PATENT DOCUMENTS

| | | |
|---|---|---|
| JP | 62-182421 | 8/1987 |
| JP | 5-231148 | 9/1993 |
| JP | 8-14043 | 1/1996 |
| JP | 8-14044 | 1/1996 |
| JP | 2000-45773 | 2/2000 |

* cited by examiner

*Primary Examiner*—Andrew M. Dolinar
(74) *Attorney, Agent, or Firm*—Harness, Dickey & Pierce, PLC

(57) ABSTRACT

Cooling water is circulated at small flow rate of 1 to 5 L/min between a bypass passage and an engine without circulating the cooling water in an oil cooler before the warming-up of the engine is completed. After the warming-up is completed, the cooling water is supplied to the oil cooler so that the engine cooling water temperature is maintained at 95° C. to 110° C. Consequently, the no local boiling of the cooling water in the engine occurs to prevent the engine from being deformed locally due to heat. Thus, the warming-up of the engine can be promoted while preventing the heat of the engine from being absorbed by the ATF through the cooling water. After the warming-up is completed, the fuel consumption can be improved by reducing the friction loss of the engine oil.

12 Claims, 8 Drawing Sheets

COOLING APPARATUS FOR LIQUID-COOLED INTERNAL COMBUSTION ENGINE

BACKGROUND OF THE INVENTION

1. Field of the Invention

The present invention relates to a cooling apparatus and, more particularly, to a cooling apparatus, for a liquid cooled internal combustion engine, such as a cooling apparatus for an automobile engine.

2. Description of the Related Art

Coolant for a liquid-cooled internal combustion engine is conventionally circulated by a pump that is driven by the engine. When the engine is started, the idling engine speed is increased both to warm-up the engine and to prevent the engine from stalling. For a coolant pump driven by the engine, the average flow rate of coolant increases because the speed of rotation of the pump increases as the engine picks up speed. Since heat transfer to the coolant increases as the average flow rate of the coolant increases, it is difficult to warm up the engine immediately after the engine is started.

To solve this problem, Japanese Kokai No. 8-14043 discloses a coolant pump driven by an electrical motor that is stopped when the engine is being warmed up.

However, stopping the coolant pump decreases the heat transfer to the coolant so that the coolant in the engine often boils locally. Local boiling of the coolant may cause the engine (cylinder head, cylinder block, etc.) to deform, thus damaging the engine.

SUMMARY OF THE INVENTION

An object of the present invention is to eliminate the drawbacks mentioned above by preventing damage to an engine (internal combustion engine) and promoting the warming-up of the engine.

To achieve the object, according to an aspect of the present invention, there is provided a cooling apparatus for a liquid-cooled internal combustion engine (10), comprising: a radiator (20) that cools coolant discharged from the engine bypasses the radiator (20) and returns to the engine (10); and a heat exchanger (90) that exchanges heat between coolant discharged from the engine (10) and a working oil; wherein when the temperature of the coolant discharged from the engine (10) is below a predetermined temperature, the flow rate of the coolant returned to the engine (10) is restricted to between 1 and 5 L/min, and the coolant discharged from the engine (10) is allowed to flow through the radiator (20) and the bypass passage (30) but not the heat exchanger (90); and when the temperature of the coolant discharged from the engine is above the predetermined temperature, the coolant discharged from the engine is allowed to flow through the radiator (20), the bypass passage (30), and the heater exchanger (90).

With this arrangement, when the temperature of the coolant is below a predetermined temperature, the coolant is circulated at small flow rate of 1 to 5 L/min between the bypass passage (30) and the liquid-cooled internal combustion engine (10) and, hence, it is possible to prevent the coolant in the liquid-cooled internal combustion engine (10) from boiling locally.

Moreover, it is possible to shorten the time necessary to complete the warming-up, in comparison with the circulation of the coolant at flow rate of 5 L/min or more. Consequently, the warming-up can be promoted while preventing the liquid-cooled internal combustion engine (cylinder head or cylinder block, etc.) from being deformed locally due to heat.

When the temperature of the coolant is below a predetermined temperature, the coolant is circulated at least between the liquid-cooled internal combustion engine (10) and the bypass passage (30) without passing in the oil heat exchanger (90) and, hence, it is possible to prevent the heat of the liquid-cooled internal combustion engine (10) from being absorbed by the working oil through the coolant. Therefore, the warming-up can be further promoted.

The oil heater exchanger (90) exchanges heat between working oil in a torque converter (80) for an automatic transmission and the coolant.

According to another aspect of the present invention, a cooling apparatus for a liquid-cooled internal combustion engine (10); comprising: a radiator (20) that cools coolant discharged from the engine (10) and returns the cooled coolant to the engine (10); a bypass passage (30) through which the coolant discharged from the engine (10) bypasses the radiator (20) and returns to the engine (10); and a heater exchanger (60) that exchange heat between coolant discharged from the engine (10) and ambient air; wherein before the engine is warmed-up of the engine, the flow rate of the coolant returned to the engine is restricted to between 1 and 5 L/min, and the coolant discharged from the engine (10) is allowed to flow through the radiator (20), the bypass passage (30) but not heat exchanger (60); and after the engine is warmed up, the coolant discharged by the engine is allowed to flow through the radiator (20), the bypass passage (30) and the heater exchanger (60).

With this arrangement, when the temperature of the coolant is below a predetermined temperature, the coolant is circulated at small flow rate of 1 to 5 L/min between the bypass passage (30) and the liquid-cooled internal combustion engine (10) and, hence, it is possible to prevent the coolant in the liquid-cooled internal combustion engine (10) from boiling locally.

Moreover, it is possible to shorten the time necessary to complete the warming-up, in comparison with the circulation of the coolant at flow rate of 5 L/min or more. Consequently, the warming-up can be promoted while preventing the liquid-cooled internal combustion engine (cylinder head or cylinder block, etc.) from being deformed locally due to heat.

Since when the temperature of the coolant is below a predetermined temperature, the coolant is circulated at least between the liquid-cooled internal combustion engine (10) and the bypass passage (30) without passing in the heating heat exchanger (60), it is possible to prevent the heat of the liquid-cooled internal combustion engine (10) from being absorbed by the air through the coolant. Therefore, the warming-up can be further promoted.

In addition to the foregoing, when the temperature of the coolant is above a predetermined temperature, the coolant is circulated to the heating heat exchanger (60) and, hence, the warming-up can be quickly carried out by the coolant of high temperature when the ambient temperature is low.

According to still another aspect of the present invention, there is provided a cooling apparatus for a liquid-cooled internal combustion engine (10); comprising: a radiator (20) that cools coolant discharged from the engine (10) and returns the cooled coolant to the engine (10); a bypass passage (30) through which the coolant discharged from the engine (10) bypasses the radiator (20) and returns to the engine (10); and a heater exchanger (90) that exchange heat between coolant discharged from the engine (10) and a working oil; wherein when the temperature of coolant discharged from the engine is below a predetermined temperature, the flow rate of the coolant returned to the engine is restricted between 1 and 5 L/min, and the coolant discharged from the engine (10) is allowed to flow through only the radiator (20) and the bypass passage (30) but not the heater exchanger (90); when the temperature of the coolant is above the predetermined temperature, the coolant discharged from the engine is allowed to flow through the radiator (20), the bypass passage (30), and the oil heat exchanger (90); when the engine (10) is warmed up, the cooling liquid is circulated to the radiator (20) so that the temperature of the coolant is approximately in the range of 95° C. to 110° C.

With this structure, when the temperature of the coolant is below a predetermined temperature, the coolant is circulated at small flow rate of 1 to 5 L/min between the bypass passage (30) and the liquid-cooled internal combustion engine (10) and, hence, it is possible to prevent the coolant in the liquid-cooled internal combustion engine (10) from boiling locally. Moreover, it is possible to shorten the time necessary to complete the warming-up, in comparison with the circulation of the coolant at flow rate of 5 L/min or more. Consequently, the warming-up can be promoted while preventing the liquid-cooled internal combustion engine (cylinder head or cylinder block, etc.) from being deformed locally due to heat.

When the temperature of the coolant is below a predetermined temperature, the coolant is circulated at least between the liquid-cooled internal combustion engine (10) and the bypass passage (30) without passing in the oil heat exchanger (90) and, hence, it is possible to prevent the heat of the liquid-cooled internal combustion engine (10) from being absorbed by the working oil through the coolant. Consequently, the warming-up can be further promoted.

When the temperature of the coolant is above a predetermined value, the coolant is circulated to the oil exchanger (90) and, hence, when the temperature of the working oil is low, the working oil can be heated by the coolant of high temperature.

Consequently, not only can the warming-up can be promoted, but also the fuel consumption can be improved by increasing the temperature of the working oil to thereby reduce the friction loss thereof.

Since the control is made so that the temperature of the coolant is maintained in the range of 95° C. to 110° C. when the warming-up is completed, the fuel consumption can be further improved by increasing the temperature of the lubricant (engine oil) which is circulated in the liquid-cooled internal combustion engine (10) to thereby reduce the friction loss.

Note that the reference numerals of the components (means) recited above exemplarily correspond to those in embodiments of the invention which will be discussed below.

DESCRIPTION OF THE PREFERRED EMBODIMENTS

A first embodiment of the invention is discussed immediately below with reference to FIG. 1, a schematic of the first embodiment. In this embodiment, a cooling apparatus for a liquid-cooled internal combustion engine is used to cool an automobile engine.

Figure 1:
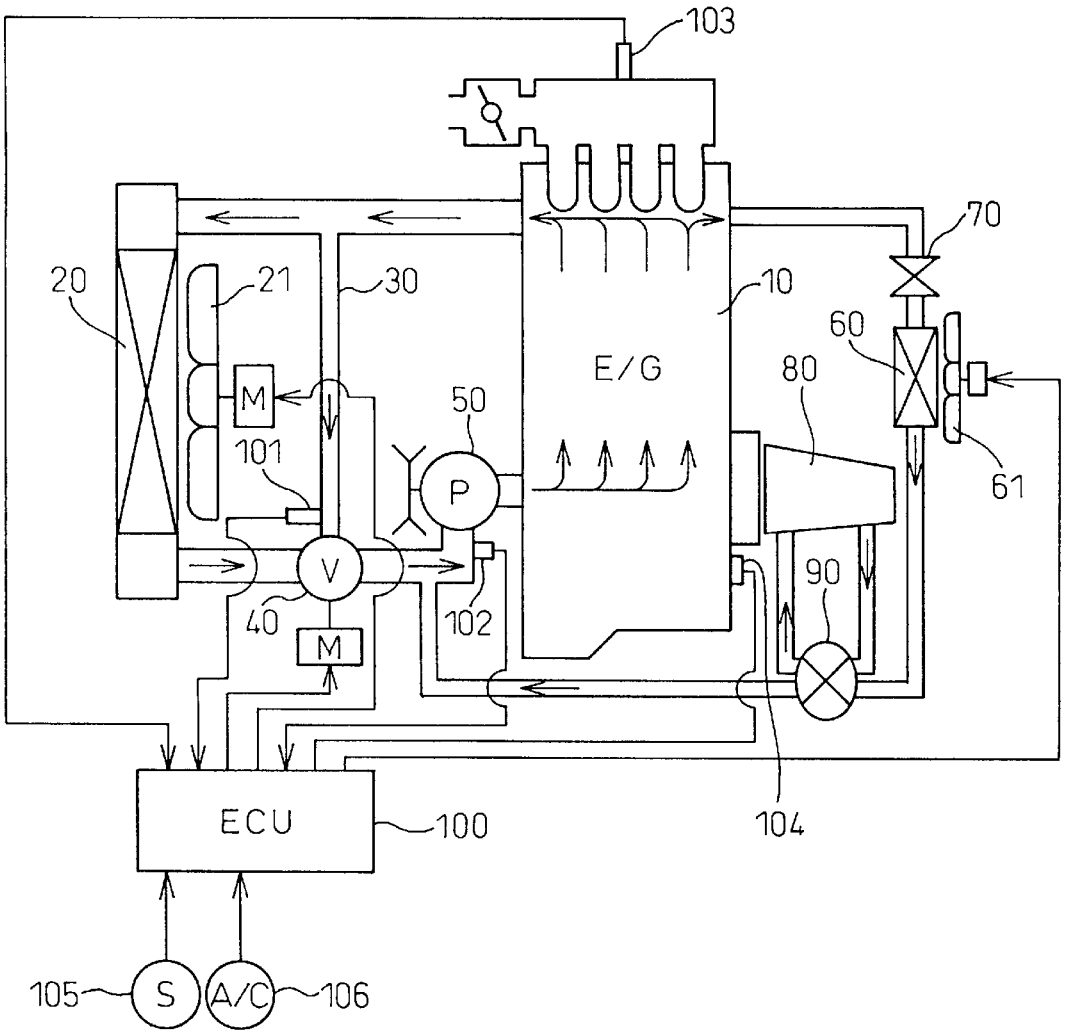
FIG. 1 is a schematic view of a cooling apparatus according to a first embodiment of the present invention.

In FIG. 1, Numeral 10 designates a liquid-cooled internal combustion engine (engine), Numeral 20 designates a radiator that cools a coolant that has been: discharged from the engine 10 and returns the cooled coolant to the engine 10, and Numeral 21 designates a cooling fan for supplying cold air to the radiator 20.

Numeral 30 designates a bypass passage through which coolant discharged from the engine 10 bypasses the radiator 20 and returns to the engine 10; Numeral 40 designates an electronic flow rate control valve Ad (referred to as the first valve) that controls the flow rates through both the radiator 20 and the bypass passage 30; Numeral 50 designates a coolant pump that is driven by the engine 10.

Numeral 60 designates a heat exchanger (heater) that heats air to be discharged into a vehicle compartment by using the coolant (engine waste heat) as a heat source; Numeral 70 designates an electromagnetic valve (referred to as the second valve) that opens and closes a passage through which the coolant is supplied to the heater 60; Numeral 61 designates an air conditioning fan, which discharges cooled air into the vehicle compartment.

Numeral 80 designates a torque converter (fluid coupling) for an automatic transmission; and Numeral 90 designates an oil cooler (oil heat exchanger) that exchanges heat between the working oil of the torque converter 80 (automatic transmission fluid or ATF) and the coolant.

Numeral 101 designates a first coolant temperature sensor that is mounted within the bypass passage 30 adjacent the first valve 40 and Numeral 102 designates a second coolant temperature sensor that is mounted adjacent the inlet port of the pump 50 to sense the temperature of the coolant returned to the engine 10.

Numeral 103 designates a pressure sensor that senses the suction negative pressure of the engine 10; Numeral 104 designates an engine speed sensor, which measures the speed of the engine 100, and Numeral 105 designates an ambient temperature sensor which measures the temperature of the ambient air.

Signals from the sensors 101 through 105 and an ON/OFF signal from a start switch 106 of the vehicle's air conditioner are input to an electronic control unit (ECU) 100, which controls the first and second valves 40 and 70 and the cooling fan 20 in accordance with predetermined programs.

The operations of the first and second valves 40 and 70 are discussed immediately below with reference to both the flow chart shown in FIG. 2 and the schematic shown in FIG. 1.

Figure 2:
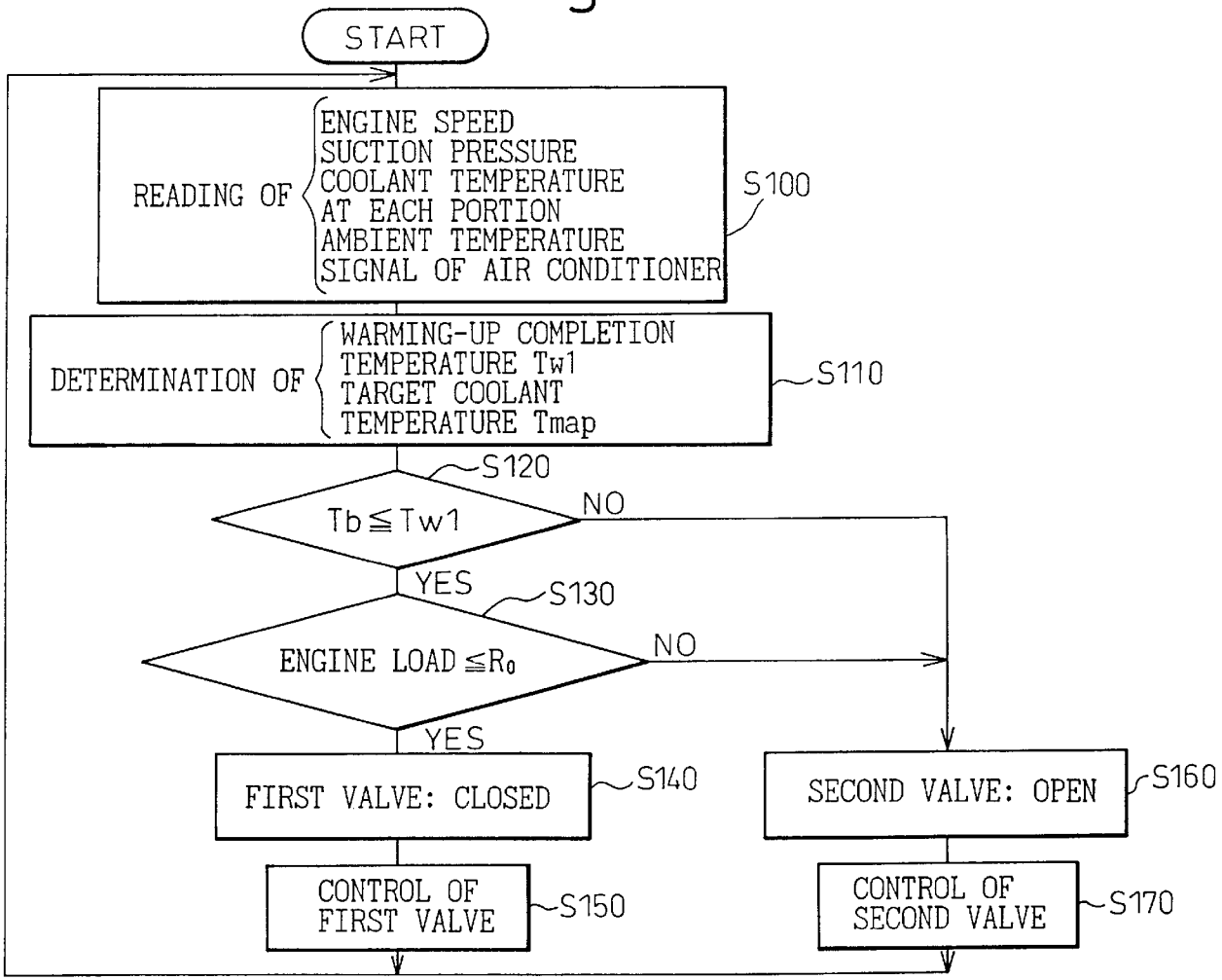
FIG. 2 is a flow chart of the operation of the cooling apparatus according to the first embodiment of the present invention.

When the engine 10 starts after the vehicle's ignition switch (not shown) is turned ON, the outputs of the speed sensor 104, the pressure sensor 103, the first and second coolant temperature sensors 101 and 102, the ambient temperature sensor 105, and the start switch 106 are read by the ECU 100, as depicted by step S100 in FIG. 2.

The ECU 100 then calculates, the engine load using the engine speed and the suction negative pressure.

Based on the engine load thus obtained, the target temperature of the coolant (referred to as the target temperature Tmap), the flow rate of the coolant to be returned to the engine 10, and the temperature of the coolant to be returned to the engine at which warm-up is deemed complete (referred to as the warm-up completion temperature Tw1) are determined from a map (not shown) (S110).

The temperature of the coolant flowing through the bypass passage 30 (referred to as the bypass coolant temperature Tb), which is measured by the first temperature sensor 101, is compared with the warm-up completion temperature Tw1, which would be 100° C. of the coolant were pure water (S120).

If the bypass coolant temperature Tb is less than the warm-up completion temperature Tw1, the engine load (as measured by the pressure sensor 103) is compared with a predetermined value R0 (S130).

If the measured engine load is less than the predetermined value R0, the second valve 70 is closed to prevent coolant from flowing to the oil cooler 90 and the warm-up control mode operation in which the coolant is circulated at least between the engine 10 and the bypass passage 30.

In the warm-up control mode, the first valve 40 limits the coolant flow through the engine 10 to between 1 and 5 L/min, which range is narrower than the conventional range of (10 to 15 L/min) (S140, S150).

If the measured bypass coolant temperature Tb is greater than the warm-up completion temperature Tw1, so that warm-up is deemed completed, or if the engine load is greater than the predetermined value R0, so that the warm-up control mode operation is no longer necessary, the second valve 70 is opened to allow the coolant to flow through the oil cooler 90. A high temperature control mode operation is the coolant temperature, as measured by the second coolant temperature sensor 103, is limited to the range 95 to 110° C. (S160, S170).

The advantages of the first embodiment are described immediately below.

Figure 8:
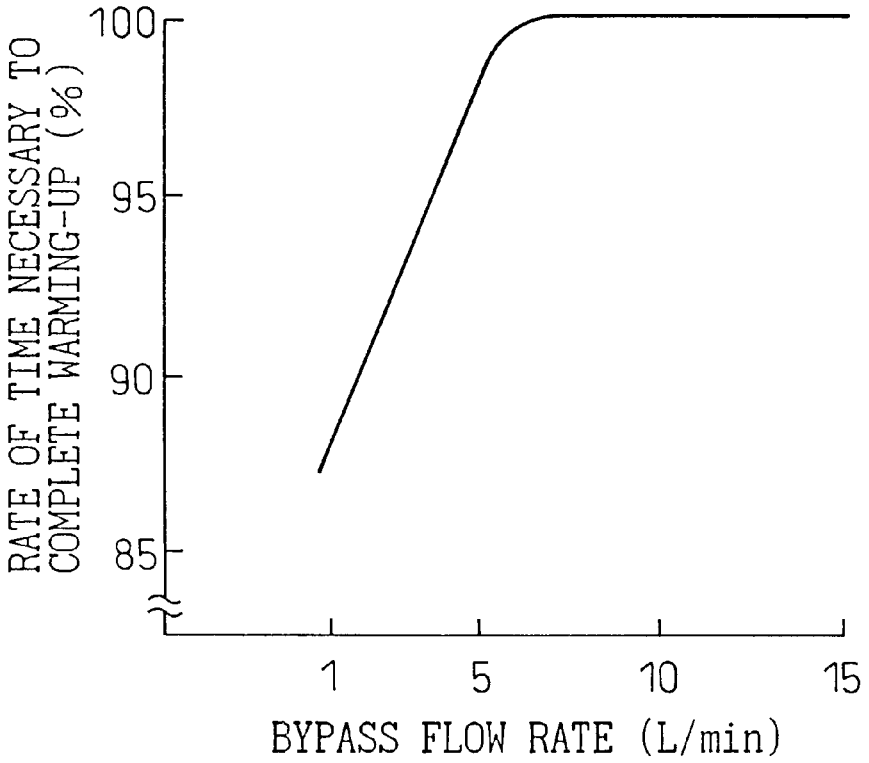
FIG. 8 is a graph of the flow rate of coolant warming-up control mode and time necessary to warm up the engine.

For low coolant temperatures, 1 to 5 L/min of coolant flows through the engine 10, which is sufficient to prevent local boiling of coolant in the engine 10. FIG. 8 shows the empirical relationship between the coolant flow rate in the warm-up control mode and the time needed to warm-up a 2000 cc (displacement) engine. When the coolant flow rate is 1 L/min, engine warm-up requires approximately 88% of the time required when the coolant flow rate is 15 L/min; when the coolant flow rate is 5 L/min engine warm-up requires approximately 98% of the time required when the coolant flow rate is 15 L/min. Thus, the time required to warm-up the engine decreases with coolant flow rate for flow rates less than 5 L/min. Such low flow rates are, however, sufficient to prevent heat-induced deformation of the engine 10 (cylinder head, cylinder block, etc.)

Moreover, when the coolant temperature is less than the warm-up completion temperature Tw1, the coolant is allowed to flow through the oil cooler 90. Since the temperature of the coolant does not decrease due to heat transfer from the coolant to the ATF, the time required to warm-up the engine is further shortened.

Figures 3A, 3B:
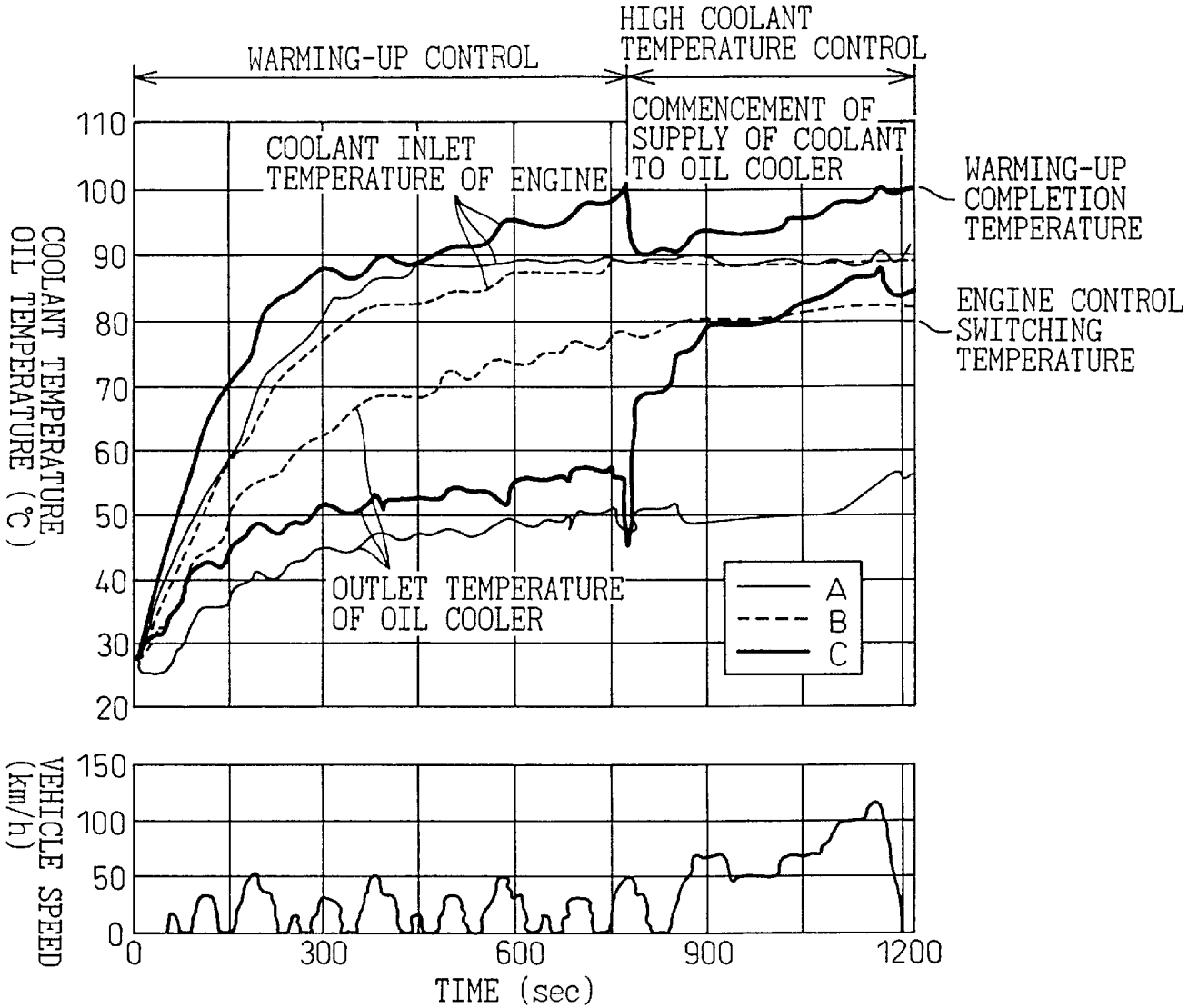
FIG. 3A is a graph showing the coolant temperature and the oil temperature as a function of time.
FIG. 3B is a graph showing a relationship between the engine speed as a function of time.
Figure 4:
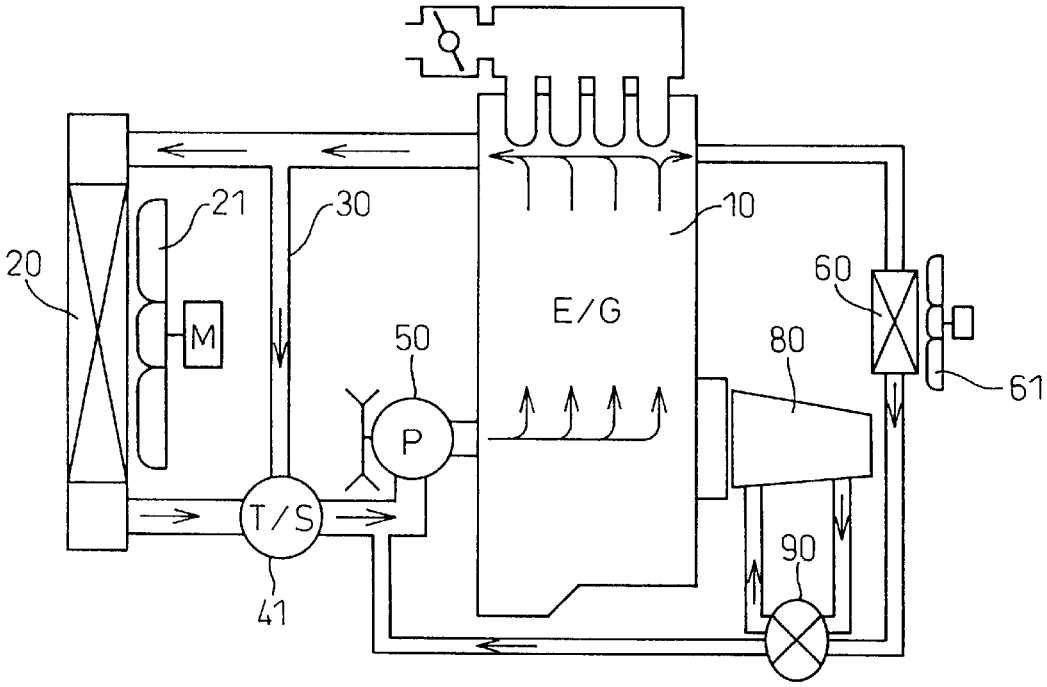
FIG. 4 is a schematic view of a conventional cooling apparatus.
Figure 5:
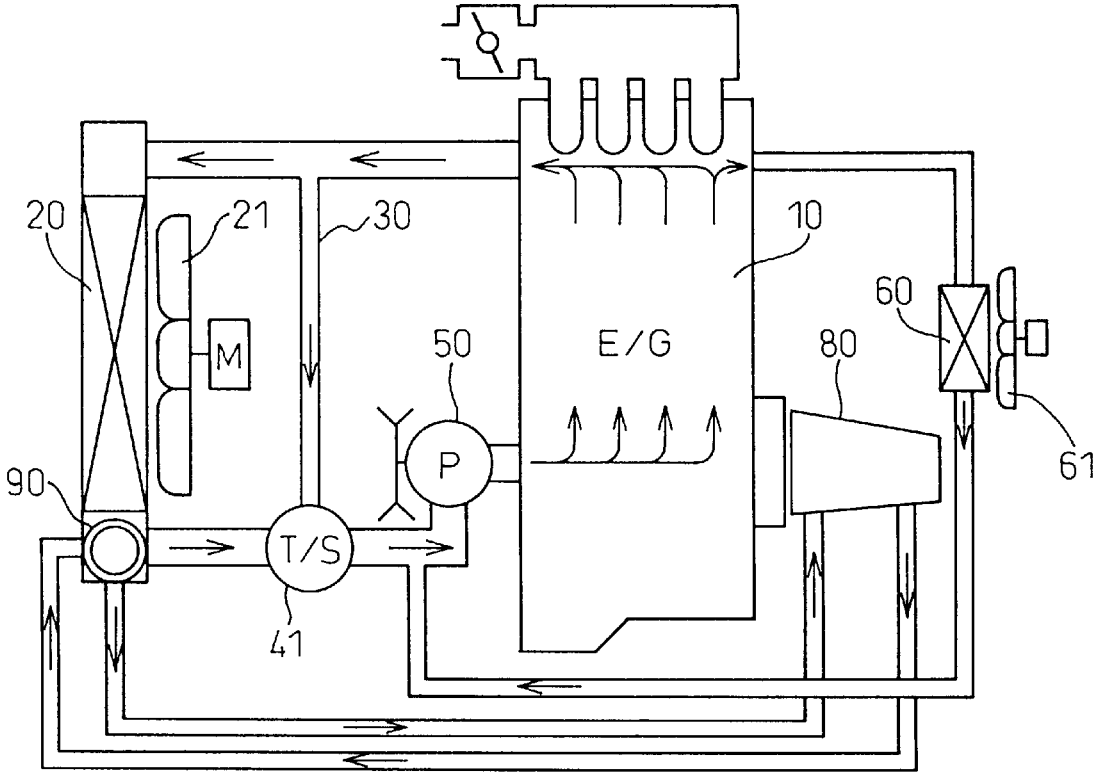
FIG. 5 is a schematic view of a conventional cooling apparatus.

FIG. 3A shows the empirical variation of the coolant temperature at the outlet of the engine and the oil temperature at the outlet of the oil cooler. In FIG. 3A, "A" represents the conventional cooling apparatus shown in FIG. 4, "B" represents the conventional cooling apparatus shown in FIG. 5, and "C" represents the cooling apparatus according to the first embodiment of the present invention. FIG. 4 depicts a conventional in which the first valve 40 is replaced with a thermostat that controls the opening of a flow control valve that utilizes the volume change of a wax material. FIG. 5 depicts a conventional cooling apparatus in which the oil cooler 90 is mounted in the radiator 20.

FIG. 3A shows that the temperature of coolant discharged from the engine quickly reaches 80° C., the temperature at which the fuel injection control mode is switched from a start control mode to a normal control mode. FIG. 3B depicts the time dependence of the vehicle speed when the coolant temperature evolves as shown in FIG. 3A.

Since coolant flows through the oil cooler 90 only when the coolant temperature exceeds the warm-up completion temperature Tw1, high-temperature coolant may be used to heat the ATF when the temperature of the ATF is low.

Therefore, not only can the engine be warmed-up more quickly, but the fuel consumption of the vehicle can also be improved by using the high-temperature coolant to warm the ATF thereby reduce the friction loss. In this embodiment, coolant flows through the oil cooler 90 only when the coolant temperature exceeds 100° C. and, hence, the temperature difference between the ATF and the coolant can be increased. Consequently, the temperature of the ATF can be rapidly increased, as shown by FIG. 3A.

Figure 6:
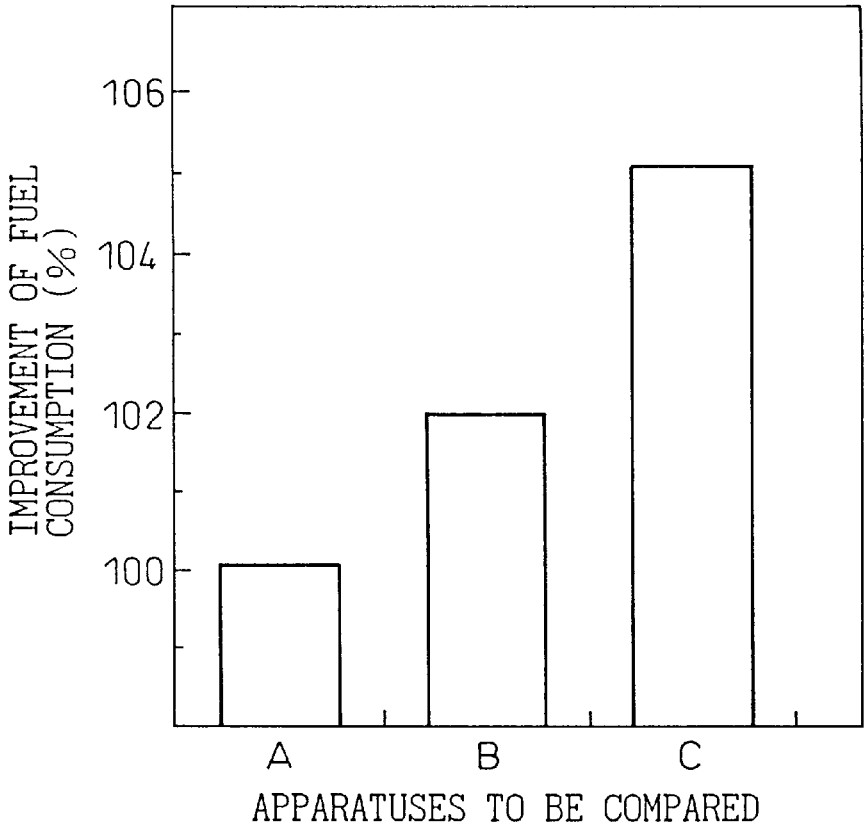
FIG. 6 is a bar graph showing the improvement of fuel consumption due to operation of the cooling apparatus according to the first embodiment of the present invention.

After the engine is warmed-up, engine coolant temperature is maintained between 95° C. and 110° C. and, hence, the fuel consumption can be improved by increasing the temperature of the lubricant (engine oil) to thereby reduce the friction loss, as may be seen in FIG. 6.

In FIG. 6 "A" represents the conventional cooling apparatus shown in FIG. 4; "B" represents to the conventional cooling apparatus shown in FIG. 5; and "C" represents the cooling apparatus according to the first embodiment of the present invention.

Figure 7:
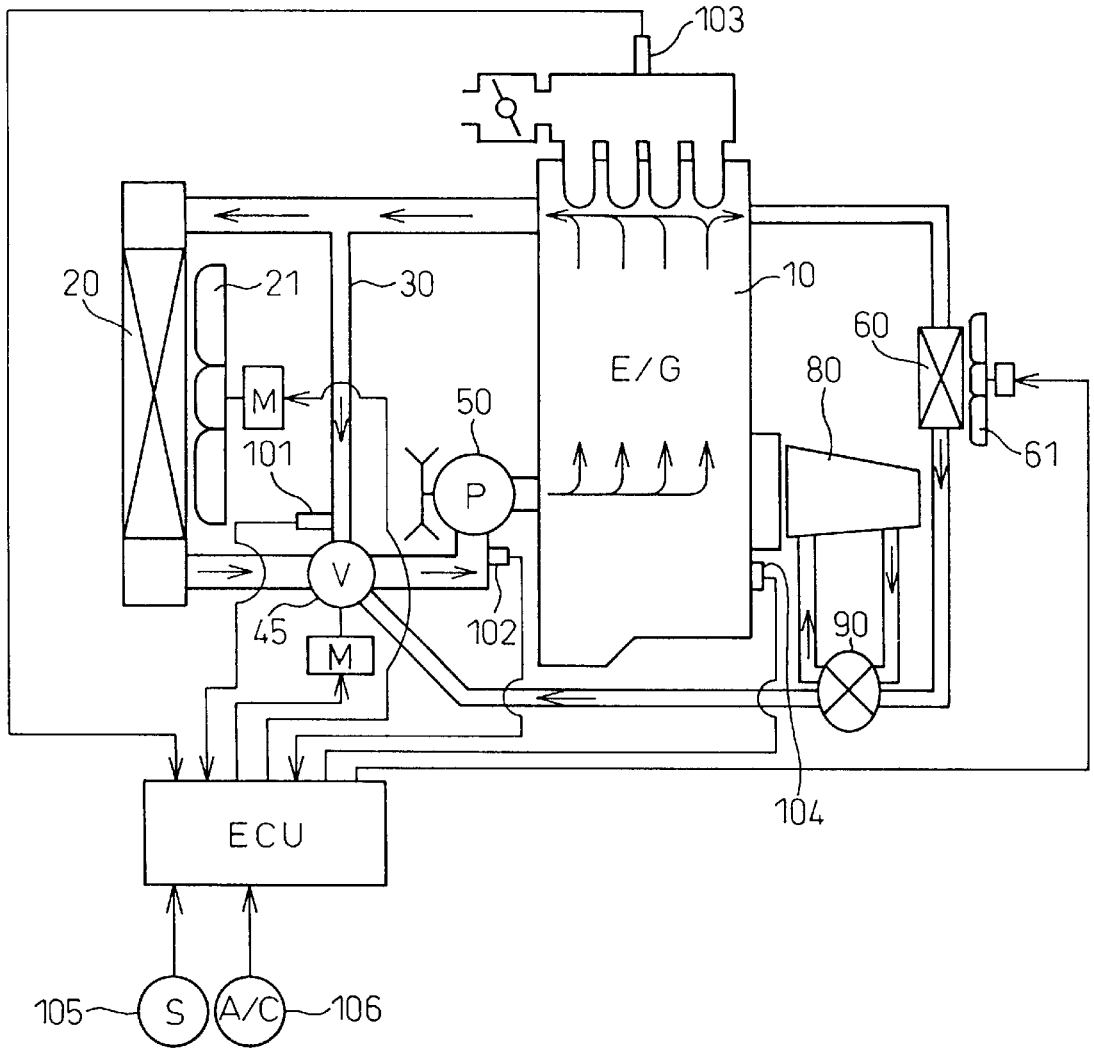
FIG. 7 is a schematic view of a cooling apparatus according to a second embodiment of the present invention.

A second embodiment of the present invention will be discussed below. In the second embodiment shown in FIG. 7, the first valve 40 and the second valve 70 are replaced with a single valve 45.

The present invention can readily be modified as follows. In the first and second embodiments, the temperature of the coolant that flows through the oil cooler 90 was taken to be the same as the temperature at which engine warm-up is deemed complete. However, these two temperatures may be allowed to differ.

Moreover, although an oil cooler that exchanges heat between the ATF and the coolant is used in the first and second embodiments, an oil cooler that exchanges heat between the engine oil and the coolant can also be used. Furthermore, although the coolant pump 50 driven by the engine 10 is used in the first and second embodiments, a coolant pump driven by an electric motor can also be used.

What is claimed is:

1. A cooling apparatus for a liquid-cooled internal combustion engine (10), comprising:

a radiator (20) that cools coolant discharged from the engine (10) and returns the cooled coolant to the engine (10);

a bypass passage (30) through which coolant discharged from the engine (10) bypasses the radiator (20) and returns to the engine (10); and a heat exchanger (90) that exchanges heat between coolant discharged from the engine (10) and a working oil;

wherein when the temperature of the coolant discharged from the engine (10) is below a predetermined temperature, the flow rate of the coolant returned to the engine (10) is restricted to between 1 and 5 L/min, and the coolant discharged from the engine (10) is allowed to flow through the radiator (20) and the bypass passage (30) but not the heat exchanger (90); and when the temperature of the coolant discharged from the engine is above the predetermined temperature, the coolant discharged from the engine is allowed to flow through the radiator (20), the bypass passage (30), and the heat exchanger (90).

2. A cooling apparatus for a liquid-cooled internal combustion engine (10) according to claim 1, wherein the heat exchanger (90) exchanges heat between working oil in a torque converter (80) for an automatic transmission and the coolant.

3. A cooling apparatus for a liquid-cooled internal combustion engine comprising:

a radiator (20) that cools coolant discharged from the engine (10) and returns the cooled coolant to the engine (10);

a bypass passage (30) through which the coolant discharged from the engine (10) bypasses the radiator (20) and returns to the engine (10); and a heat exchanger (60) that exchanges heat between coolant discharged from the engine (10) and ambient air;

wherein before the engine is warmed-up, the flow rate of the coolant returned to the engine is restricted to between 1 and 5 L/min, and the coolant discharged from the engine (10) is allowed to flow through the radiator (20), the bypass passage (30) but not the heat exchanger (60); and after the engine is warmed up, the coolant discharged by the engine (10) is allowed to flow through the radiator (20), the bypass passage (30) and the heat exchanger (60).

4. A cooling apparatus for a liquid-cooled internal combustion engine (10), comprising:

a radiator (20) that cools coolant discharged from the engine (10) and returns the cooled coolant directly to the engine;

a bypass passage (30) through which the coolant discharged from the engine (10) bypasses the radiator (20) and returns directly to the engine (10); and a heat exchanger (90) that exchanges heat between coolant discharged from the engine (10) and a working oil;

wherein when the temperature of the coolant discharged from the engine is below a predetermined temperature, the flow rate of the coolant returned to the engine is restricted to between 1 and 5 L/min, and the coolant discharged from the engine (10) is allowed to flow through the radiator (20) and the bypass passage (30) but not the heat exchanger (90);

when the temperature of the coolant discharged from the engine is above the predetermined temperature, the coolant discharged from the engine is allowed to flow through the radiator (20), the bypass passage (30), and the heat exchanger (90).

5. A cooling apparatus for a liquid-cooled internal combustion engine (10), comprising:

a radiator (20) that cools coolant discharged from the engine (10) and returns the cooled coolant to the engine (10);

a bypass passage (30) through which coolant discharged from the engine (10) bypasses the radiator (20) and returns to the engine (10);

a heat exchanger (90) for torque converter that exchanges heat between coolant discharged from the engine (10) and a working oil in a torque converter for an automatic transmission;

a coolant temperature sensor that measures a coolant temperature; and valve means comprising at least one valve, which restricts a flow rate of the coolant returning to the engine (10) and controls a flow rate of the coolant flowing through said radiator (20), said bypass passage (30) and the heat exchanger (90) for torque converter;

control means to which signals from the coolant temperature sensor are input and which controls said valve means electrically;

wherein when the temperature measure from the coolant temperature sensor is below a predetermined temperature, said control means restricts a flow rate of the coolant returning to the engine to 1 and 5 L/min via the valve means and permits the coolant discharged from the engine (10) to pass through the bypass passage (30) while does not permit the coolant to pass through the heat exchanger (90) for torque converter; and when the coolant temperature measure from said coolant temperature sensor exceeds the predetermined temperature, said control means permits said coolant discharged from the engine to pass through said radiator (20), said bypass passage (30) and said heat exchanger (90) for torque converter via said valve means.

6. A cooling apparatus for a liquid-cooled internal combustion engine according to claim 5, said engine (10) is directed to driving a vehicle, the cooling apparatus comprises a heat exchanger for heating air that exchanges heat between said coolant and ambient air in order to increase the temperature in a vehicle compartment; and when the coolant temperature measure from said coolant temperature sensor is below the predetermined temperature, the control means restricts the flow rate of the coolant returning to the engine (10) to 1–5 L/min via the valve means and permits the coolant discharged from the engine 910) to pass through said bypass passage (30) while does not permit the coolant to pass through the heat exchanger (90) for torque converter and the heat exchanger for heating air; and when the coolant temperature measured from said coolant temperature sensor exceeds the predetermined temperature, said control means permits said coolant discharged from the engine (10) to pass through said radiator (20), said heat exchanger (90) for torque converter and said heat exchanger for heating air via said valve means.

7. A cooling apparatus for a liquid-cooled internal combustion engine (10) according to claim 5, said control means comprises a means for calculating a target coolant temperature of said coolant, and after the coolant temperature measured from said coolant temperature sensor exceeds the predetermined temperature, said control means controls the coolant passing through said radiator (20), said bypass passage (30) and said heat exchanger (90) for torque converter via said valve means based on the coolant temperature measured from said coolant temperature sensor and said target coolant temperature, and said control means controls so that the temperature of said coolant is approximately in the range of 95° C. to 110° C.

8. A cooling apparatus for a liquid-cooled internal combustion engine according to claim 5, said valve means comprises an electronic flow rate control valve that adjusts a flow rate of said coolant flowing through the radiator (20) and a flow rate of said coolant flowing through the bypass passage (30), said coolant temperature sensor comprise a first coolant temperature sensor (101) that is mounted adjacent said bypass passage (30) and measures the bypass coolant temperature Tb of the coolant flowing through said bypass passage (30), and a second coolant temperature sensor (102) that measures a temperature of the coolant returning to said engine (10), said control means comprises:

engine load calculation means that calculates the load of said engine (10);

target coolant temperature determining means that determines target coolant temperature Tmap which is a target temperature of the coolant;

warm-up completion temperature determining means that determines a warm-up completion temperature Tw1 at which warm-up is deemed complete; and warm-up control mode operation means that controls said valve means to prevent said coolant from flowing to the heat exchanger (90) for torque converter and to permit said coolant to flow between said engine and said bypass passage at 1–5 L/min when the bypass coolant temperature Tb is below the warm-up completion temperature Tw1 by comparing said bypass coolant temperature Tb and said warm-up completion temperature Tw1; and said warm-up control mode operation means controls said valve means to permit said coolant to flow to said heat exchange (90) for torque converter and to adjust the flow rate of said coolant flowing through the radiator (20) so that the coolant temperature measured from said second coolant temperature sensor (102) is approximately in the range of 95° C.–110° C. after said bypass coolant temperature Tb exceeds said warm-up completion temperature Tw1 and the warm-up is completed.

9. A cooling apparatus for a liquid-cooled internal combustion engine (10), which is driving a vehicle, comprising:

a radiator (20) that cools coolant discharged from the engine and returns the cooled coolant to the engine (10);

a bypass passage (30) through which the coolant discharged from the engine (10) bypasses the radiator (20) and returns to the engine (10);

a heat exchanger for heating air that exchanges heat between coolant discharged from the engine (10) and ambient air in order to increase the temperature in a vehicle compartment;

a coolant temperature sensor which measures a coolant temperature;

valve means comprising at least one valve, which restricts a flow rate of the coolant returning to said engine (10) and controls a flow rate of the coolant rate flowing through said radiator (20) and said heat exchanger for heating air;

control means to which signals from the coolant temperature sensor are input and which controls said valve means electrically;

wherein when the temperature measured from the coolant temperature sensor is below a predetermined temperature, said control means restricts a flow rate of the coolant returning to the engine to 1 and 5 L/min via the valve means and permits the coolant discharged from the engine (10) to pass through the bypass passage (30) while does not permit the coolant to pass through the heat exchanger for heating air; and when the coolant temperature measured from said coolant temperature sensor exceeds the predetermined temperature, said control means permits said coolant discharged from the engine to pass through said radiator (20), said bypass passage (30) and said heat exchanger for heating air via said valve means.

10. A cooling apparatus for a liquid-cooled internal combustion engine (10), which is driving a vehicle, according to claim 9, said control means comprises a means for calculating a target coolant temperature of said coolant, and after the coolant temperature measured from said coolant temperature sensor exceeds the predetermined temperature, said control means controls the coolant passing through said radiator (20), said bypass passage (30) and said heat exchanger for heating air via said valve means based on the coolant temperature measured from said coolant temperature sensor and said target coolant temperature, and said control means controls so that the temperature of said coolant is approximately in the range of 95° C. to 110° C.

11. A cooling apparatus for a liquid-cooled internal combustion engine (10), which is driving a vehicle, according to claim 9, said valve means comprises an electronic flow rate control valve that adjusts a flow rate of said coolant flowing through the radiator (20) and a flow rate of said coolant flowing through the bypass passage (30), said coolant temperature sensor comprise a first coolant temperature sensor (101) that is mounted adjacent said bypass passage (30) and measures the bypass coolant temperature Tb of the coolant flowing through said bypass passage (30), and a second coolant temperature sensor (102) that measures a temperature of the coolant returning to said engine (10), said control means comprises:

engine load calculation means that calculates the load of said engine (10);

target coolant temperature determining means that determines target coolant temperature Tmap which is a target temperature of the coolant;

warm-up completion temperature determining means that determines a warm-up completion temperature Tw1 at which warm-up is deemed complete; and warm-up control mode operation means that controls said valve means to prevent said coolant from flowing to the heat exchanger for heating air and to permit said coolant to flow between said engine and said bypass passage at 1–5 L/min when the bypass coolant temperature Tb is below the warm-up completion temperature Tw1 by comparing said bypass coolant temperature Tb and said warm-up completion temperature Tw1; and said warm-up control mode operation means controls said valve means to permit said coolant to flow to said heat exchanger for heating air and to adjust the flow rate of said coolant flowing through the radiator (20) so that the coolant temperature measured from said second coolant temperature sensor 9102) is approximately in the range of 95° C.–110° C. after said bypass coolant temperatures Tb exceeds said warm-up completion temperature Tw1 and the warm-up is completed.

12. A cooling apparatus for a liquid-cooled internal combustion engine (10), which is driving a vehicle, comprising:

a radiator (20) that cools coolant discharged from the engine (10) and returns the cooled coolant to the engine (10);

a bypass passage (30) through which coolant discharged from the engine (10) bypasses the radiator (20) and returns to the engine (10);

at least one heat exchanger that is mounted within the vehicle and that exchanges heat between coolant discharged from the engine and ambient air or a working oil;

a coolant temperature sensor that measures a coolant temperature;

valve means comprising at least one valve, which restricts a flow rate of the coolant returning to the engine and controls a flow rate of the coolant flowing through said radiator (20), said bypass passage (30) and said heat exchanger; and control means to which signal from the coolant temperature sensor are input and which controls said valve means electrically;

wherein when the temperature measured from the coolant temperature sensor is below a predetermined temperature, said control means restricts a flow rate of the coolant returning to the engine to 1 and 5 L/min via the valve means and permits the coolant discharged from the engine (10) to pass through the bypass passage (30) while does not permit the coolant to pass through any heat exchanger mounted in the vehicle; and when the coolant temperature measured from said coolant temperature sensor exceeds the predetermined temperature, said control means permits said coolant discharged from the engine to pass through said radiator (20), said bypass passage (30) and said heat exchanger via said valve means.

* * * * *

UNITED STATES PATENT AND TRADEMARK OFFICE

CERTIFICATE OF CORRECTION

PATENT NO. : 6,530,347 B2
DATED : March 11, 2003
INVENTOR(S) : Eizo Takahashi et al.

It is certified that error appears in the above-identified patent and that said Letters Patent is hereby corrected as shown below:

Column 8,
Line 28, after “while” insert -- it --

Column 9,
Line 11, “comprise” should be -- comprises --

Column 10,
Line 7, after “while” insert -- it --
Line 33, “comprise” should be -- comprises --
Line 63, “9102)” should be -- 102 --
Line 65, “temperatures” should be -- temperature --

Column 12,
Line 1, “signal” should be -- signals --
Line 7, “1 and 5” should be -- 1 - 5 --
Line 11, after “while” insert -- it --

Signed and Sealed this

Twentieth Day of January, 2004

JON W. DUDAS
*Acting Director of the United States Patent and Trademark Office*